US009837798B1

(12) United States Patent
Yamada et al.

(10) Patent No.: US 9,837,798 B1
(45) Date of Patent: Dec. 5, 2017

(54) SPARK PLUG

(71) Applicant: NGK SPARK PLUG CO., LTD., Nagoya-shi, Aichi (JP)

(72) Inventors: Yuichi Yamada, Niwa-gun (JP); Yuichi Matsunaga, Konan (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 15/481,543

(22) Filed: Apr. 7, 2017

(30) Foreign Application Priority Data

May 10, 2016 (JP) ..... 2016-094220

(51) Int. Cl.

| | |
|---|---|
| ***H01T 13/32*** | (2006.01) |
| ***H01T 13/39*** | (2006.01) |
| *H01T 13/41* | (2006.01) |
| *H01T 21/02* | (2006.01) |

(52) U.S. Cl.
CPC ..... *H01T 13/32* (2013.01); *H01T 13/39* (2013.01); *H01T 13/41* (2013.01); *H01T 21/02* (2013.01)

(58) Field of Classification Search
CPC ..... H01T 13/32; H01T 13/39; H01T 13/41; H01T 21/00; H01T 21/02
See application file for complete search history.

(56) References Cited

U.S. PATENT DOCUMENTS

| | | | | |
|---|---|---|---|---|
| 6,346,766 | B1 * | 2/2002 | Kanao | H01T 13/39 313/141 |
| 6,630,771 | B1 * | 10/2003 | Ulm | H01T 13/39 313/141 |
| 2005/0093412 | A1 * | 5/2005 | Lykowski | H01T 13/39 313/141 |
| 2009/0051259 | A1 | 2/2009 | Yoshimoto | |

(Continued)

FOREIGN PATENT DOCUMENTS

| | | |
|---|---|---|
| EP | 2 028 736 A2 | 2/2009 |
| EP | 2 940 810 A1 | 11/2015 |

(Continued)

OTHER PUBLICATIONS

European Patent Office, Extended European Search Report issued in corresponding Application No. EP 17159450, dated Sep. 21, 2017.

*Primary Examiner* — Mariceli Santiago
(74) *Attorney, Agent, or Firm* — Stites & Harbison, PLLC; Jeffrey A. Haeberlin

(57) ABSTRACT

A tip that contains a noble metal is joined to a joining surface of an electrode base material of a ground electrode via a welded portion. On cross-sections of the tip and the electrode base material in a longitudinal direction of the joining surface, the welded portion has a void above the joining surface, and a continuous distance of the welded portion on the joining surface is less than or equal to 0.5 mm, whereby thermal stress due to a difference in thermal expansion between the tip and the electrode base material can be reduced. A total of continuous distances of the welded (Continued)

portions on the joining surface, are 0.4 times to 0.8 times a length from an end of the tip to another end thereof, whereby joining strength of the welded portion can be assured. Peeling at the tip or falling-off of the tip due to thermal stress can be less likely to occur, whereby durability of the ground electrode can be improved.

3 Claims, 7 Drawing Sheets

(56) References Cited

U.S. PATENT DOCUMENTS

| | | | | |
|---|---|---|---|---|
| 2010/0259154 | A1* | 10/2010 | Nakamura | H01T 13/32 313/141 |
| 2013/0214670 | A1* | 8/2013 | Suzuki | H01T 13/32 313/141 |
| 2015/0357797 | A1 | 12/2015 | Yoshimoto | |

FOREIGN PATENT DOCUMENTS

| | | | | |
|---|---|---|---|---|
| JP | 2003-217792 | A | | 7/2003 |
| JP | 2003229230 | A | * | 8/2003 |

* cited by examiner

SPARK PLUG

CROSS REFERENCE TO RELATED APPLICATION

The present application claims priority to Japanese Patent Application No. 2016-094220, which was filed on May 10, 2016, the disclosure of which is herein incorporated by reference in its entirety.

BACKGROUND OF THE INVENTION

Field of the Invention

The present invention relates to a spark plug, and particularly to a spark plug that allows improvement of durability of a ground electrode.

Description of Related Art

A spark plug in which a tip containing a noble metal is joined to an electrode base material of a ground electrode, in order to improve spark wear resistance of the ground electrode, is known (Patent Document 1).

PRIOR ART DOCUMENT

Patent Document 1 is Japanese Patent Application Laid-Open (kokai) No. 2003-217792.

SUMMARY OF THE INVENTION

However, in the technique disclosed in Patent Document 1, the tip is jointed to the electrode base material via a welded portion formed over the entirety of an interface of the tip, so that thermal stress may cause peeling at the tip or falling-off of the tip. Therefore, a problem arises that durability of the ground electrode may be reduced.

The present invention is made in order to solve the aforementioned problem, and an object of the present invention is to provide a spark plug that allows improvement of durability of a ground electrode.

In order to attain the above object, a spark plug according to a first aspect of the present invention includes a tip that contains a noble metal and forms a spark gap between the tip and a center electrode (i.e., positioned to form a spark gap between the tip and the center electrode). The tip is joined to a joining surface of an electrode base material (or, as used interchangeably herein, an electrode base) of a ground electrode via a welded portion. On cross-sections of the tip and the electrode base material in a longitudinal direction of the joining surface, the welded portion has a void above the joining surface, and a continuous distance of the welded portion on the joining surface is less than or equal to 0.5 mm. In other words, the tip defines one or more voids above the joining surface and between the plurality of welded portions, and the welded portions are each less than or equal to 0.5 mm in the longitudinal direction. Therefore, as compared to a case where the entirety of the interface of the tip is joined to the electrode base material, thermal stress due to a difference in thermal expansion between the tip and the electrode base material can be reduced. A total of continuous distances of the welded portions on the joining surface, are 0.4 times to 0.8 times a length from an end of the tip to another end thereof, whereby joining strength of the welded portion can be assured. As a result, peeling at the tip or falling-off of the tip due to thermal stress, vibration, or the like can be less likely to occur. Therefore, an effect of improving durability of the ground electrode can be obtained.

In the spark plug according to a second aspect of the present invention, the tip has a plurality of divisional tips arranged on the joining surface. The welded portions adjoin each of the divisional tips to the joining surface. The size of the divisional tip can be reduced as compared to an integral tip. Therefore, in addition to the effect by the first aspect being obtained, an effect of reducing thermal stress caused by a difference in thermal expansion between the tip and the electrode base material can be enhanced. Further, a maximum spatial distance, on the joining surface, between the divisional tips adjacent to each other is less than or equal to 0.3 mm. Therefore, spark discharge at the electrode base material between the divisional tips can be less likely to occur. As a result, an effect of reducing spark wear of the electrode base material between the divisional tips can be obtained.

In the spark plug according to a third aspect of the present invention, on the cross-sections of the tip and the electrode base material in the longitudinal direction of the joining surface, the length from the end of the tip to the other end thereof is greater than or equal to 1.5 mm. The greater the length of the tip is, the greater the dimensional change due to heat is, so that peeling at the tip or falling-off of the tip is likely to occur. However, a plurality of voids are formed above the joining surface at the welded portion, whereby the peeling or falling-off can be prevented. As a result, in addition to the effect by the first aspect or the second aspect being obtained, even when the tip has the length which is greater than or equal to 1.5 mm, peeling at the tip or falling-off of the tip due to thermal stress can be less likely to occur.

BRIEF DESCRIPTION OF THE DRAWINGS

Illustrative aspects of the invention will be described in detail with reference to the following figures wherein:

FIG. 2(*b*) is a front view of the tip. FIG. 2(*c*) is a bottom view of the tip. FIG. 2(*d*) is a side view of the tip.

FIG. 3(*b*) is a cross-sectional view of the ground electrode taken along the line represented by arrows IIIb-IIIb shown in FIG. 3(*a*).

FIG. 4(*b*) is a front view of the tip. FIG. 4(*c*) is a bottom view of the tip. FIG. 4(*d*) is a side view of the tip.

FIG. 5(*b*) is a cross-sectional view of the ground electrode taken along the line represented by arrows Vb-Vb shown in FIG. 5(*a*).

FIG. 6(*b*) is a cross-sectional view of the ground electrode taken along the line represented by arrows VIb-VIb shown in FIG. 6(*a*).

FIG. 7(*b*) is a cross-sectional view of the ground electrode taken along the line represented by arrows VIIb-VIIb shown in FIG. 7(*a*).

DETAILED DESCRIPTION OF EXEMPLARY EMBODIMENTS OF THE INVENTION

Figure 1:
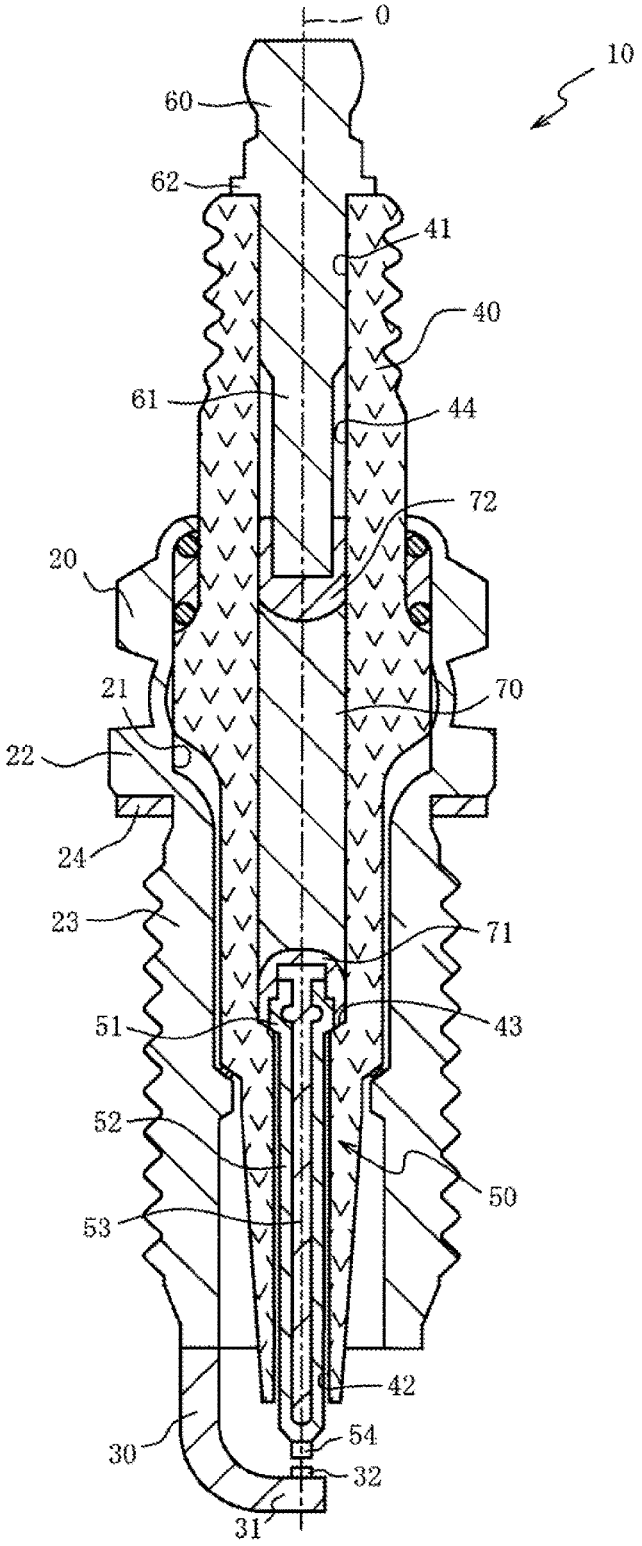
FIG. 1 is a cross-sectional view of a spark plug according to a first embodiment of the present invention.
Figure 2A:
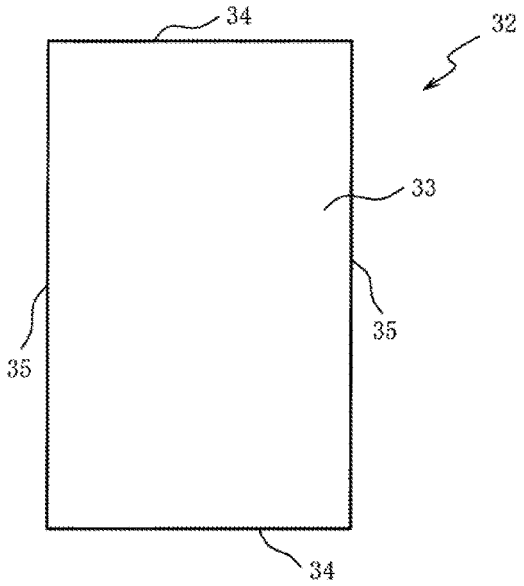
FIG. 2(*a*) is a plan view of a tip.
Figure 2B:
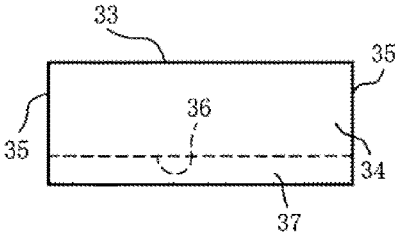
Figure 2D:
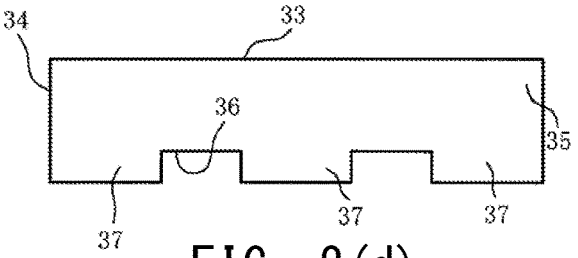
Figure 2C:
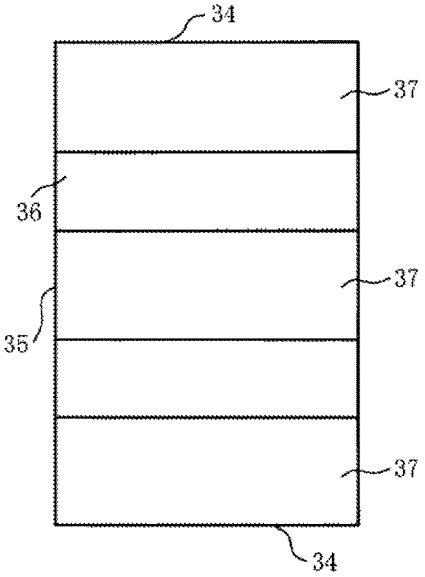

Hereinafter, preferred embodiments of the present invention will be described with reference to the accompanying drawings. FIG. 1 is a cross-sectional view of a spark plug 10, according to a first embodiment of the present invention, taken along a plane including a central axis O. In FIG. 1, the lower side on the surface of the drawing sheet is referred to as a front side of the spark plug 10, and the upper side on the surface of the drawing sheet is referred to as the rear side of the spark plug 10. As shown in FIG. 1, the spark plug 10 includes a metal shell 20, a ground electrode 30, an insulator 40, a center electrode 50, a metal terminal 60, and a resistor 70.

The metal shell 20 is an almost cylindrical member that is fixed in a screw hole (not shown) of an internal combustion engine, and has a through hole 21 that penetrates therethrough along the central axis O. The metal shell 20 is formed of a metal material (for example, low-carbon steel or the like) having conductivity. The metal shell 20 includes: a seat portion 22 that protrudes outward in the radial direction so as to be flange-shaped; and a screw portion 23 formed on the outer circumferential surface forward of the seat portion 22. An annular gasket 24 is fitted between the seat portion 22 and the screw portion 23. When the screw portion 23 is fitted into the screw hole of the internal combustion engine, the gasket 24 seals a gap between the metal shell 20 and the internal combustion engine (engine head).

The ground electrode 30 includes: an electrode base material 31 which is made of a metal (for example, a nickel-based alloy) and is joined to the front end of the metal shell 20; and a tip 32 joined to the end of the electrode base material 31. The electrode base material 31 is a rod-shaped member that is bent toward the central axis O so as to intersect the central axis O. The tip 32 is a member formed of a noble metal such as platinum, iridium, ruthenium, or rhodium, or an alloy containing such a noble metal as a main component. The tip 32 is joined by laser beam welding, resistance welding, or the like at such a position that the tip 32 intersects the central axis O. The melting point of the tip 32 is higher than the melting point of the electrode base material 31, and the thermal expansion coefficient of the tip 32 is less than the thermal expansion coefficient of the electrode base material 31.

The insulator 40 is an almost cylindrical member formed of alumina or the like which is excellent in mechanical property and insulation property at a high temperature. The insulator 40 has an axial hole 41 that penetrates therethrough along the central axis O. The insulator 40 is inserted into the through hole 21 of the metal shell 20 and the metal shell 20 is fixed on the outer circumference of the insulator 40. The front end and the rear end of the insulator 40 are exposed from the through hole 21 of the metal shell 20.

The axial hole 41 has: a first hole portion 42 disposed on the front side of the insulator 40; a step portion 43 that connects to the rear end of the first hole portion 42 and has the diameter enlarged toward the rear side; and a second hole portion 44 disposed on the side rearward of the step portion 43. The inner diameter of the second hole portion 44 is set to be larger than the inner diameter of the first hole portion 42.

The center electrode 50 is a rod-shaped electrode in which, in a tubular electrode base material having the bottom, a core material 53 having a thermal conductivity that is more excellent than the electrode base material is embedded. The core material 53 is formed of copper or an alloy containing copper as a main component. The center electrode 50 includes: a head portion 51 disposed at the step portion 43 of the axial hole 41; and a leg portion 52 that extends along the central axis O on the first hole portion 42 side.

The front end of the leg portion 52 is exposed from the first hole portion 42, and a tip 54 is joined thereto by laser beam welding. The tip 54 is a columnar member formed of a noble metal such as platinum, iridium, ruthenium, or rhodium, or an alloy containing such a noble metal as a main component, and opposes the tip 32 of the ground electrode 30 via a spark gap.

The metal terminal 60 is a rod-shaped member to which a high-voltage cable (not shown) is connected, and is formed of a metal material (for example, low-carbon steel or the like) having conductivity. The front side portion of the metal terminal 60 is disposed in the axial hole 41 of the insulator 40.

The resistor 70 is a member for reducing electric wave noise generated when spark occurs, and is disposed in the second hole portion 44 between the metal terminal 60 and the center electrode 50. A conductive glass seal 71 is disposed between the resistor 70 and the center electrode 50, and a conductive glass seal 72 is disposed between the resistor 70 and the metal terminal 60. The glass seal 71 contacts with the resistor 70 and the center electrode 50, and the glass seal 72 contacts with the resistor 70 and the metal terminal 60. As a result, the center electrode 50 and the metal terminal 60 are electrically connected with each other via the resistor 70 and the glass seals 71, 72.

The spark plug 10 is manufactured in, for example, a method described below. Firstly, the center electrode 50 is inserted through the second hole portion 44 of the insulator 40. The center electrode 50 has the tip 54 welded to the front end of the leg portion 52. The center electrode 50 is disposed such that the head portion 51 thereof is supported by the step portion 43, and the front end portion thereof is exposed to the outside from the front end of the axial hole 41.

Next, raw material powder of the glass seal 71 is charged through the second hole portion 44 into a portion around the head portion 51 and a rear end side portion thereof. A compression bar member (not shown) is used to preform preliminary compression on the raw material powder, of the glass seal 71, having been charged through the second hole portion 44. Onto a formed body of the formed raw material powder of the glass seal 71, the raw material powder of the resistor 70 is charged. The compression bar member (not shown) is used to perform preliminary compression on the raw material powder, of the resistor 70, having been charged through the second hole portion 44. Next, onto the raw material powder of the resistor 70, the raw material powder of the glass seal 72 is charged. The compression bar member (not shown) is used to perform preliminary compression on the raw material powder, of the glass seal 72, having been charged through the second hole portion 44.

Thereafter, a front end portion 61 of the metal terminal 60 is inserted through the rear end side of the axial hole 41, and the metal terminal 60 is positioned such that the front end portion 61 contacts with the raw material powder of the glass seal 72. Next, for example, while heating up to a temperature higher than a softening point of a glass component contained in each raw material powder is performed, the metal terminal 60 is pressed in until the front end surface of a protrusion portion 62 provided on the rear end side of the metal terminal 60 contacts with the rear end surface of the insulator 40, and load is applied, in the axial direction, to the raw material powder of each of glass seal 71, the resistor 70, and glass seal 72 by the front end portion 61. As a result, each raw material powder is compressed and sintered, and the glass seal 71, the resistor 70, and the glass seal 72 are formed in the insulator 40.

Next, the metal shell 20 to which the ground electrode 30 is previously joined, is mounted to the outer circumference of the insulator 40. Thereafter, the tip 32 is welded to the electrode base material 31 of the ground electrode 30, and the electrode base material 31 is bent such that the tip 32 of the ground electrode 30 opposes the tip 54 of the center electrode 50 in the axial direction, to obtain the spark plug 10.

The tip 32 will be described with reference to FIG. 2. FIG. 2(*a*) is a plan view of the tip 32, FIG. 2(*b*) is a front view of the tip 32, FIG. 2(*c*) is a bottom view of the tip 32, and FIG. 2(*d*) is a side view of the tip 32.

The tip 32 is a member that is formed, in a rectangular parallelepiped, of a noble metal or an alloy containing a noble metal as a main component. The tip 32 has: a rectangular top surface 33 that opposes the center electrode 50 (see FIG. 1); a rectangular bottom surface 36 disposed opposite to the top surface 33; and side surfaces 34, 35 that connect between the top surface 33 and the bottom surface 36. The side surfaces 35 have long sides (edges that connect between the side surfaces 35 and the top surface 33) which are longer than long sides (edges that connect between the side surfaces 34 and the top surface 33) of the side surfaces 34.

The bottom surface 36 has a plurality of protrusions 37 that protrude from the bottom surface 36. In the present embodiment, three protrusions 37 are disposed almost parallel to the long sides of the side surfaces 34 so as to be spaced from each other. The protrusions 37 are formed on the bottom surface 36 of the tip 32 by a base material of the tip 32 being, for example, rolled or cut.

Figure 3A:
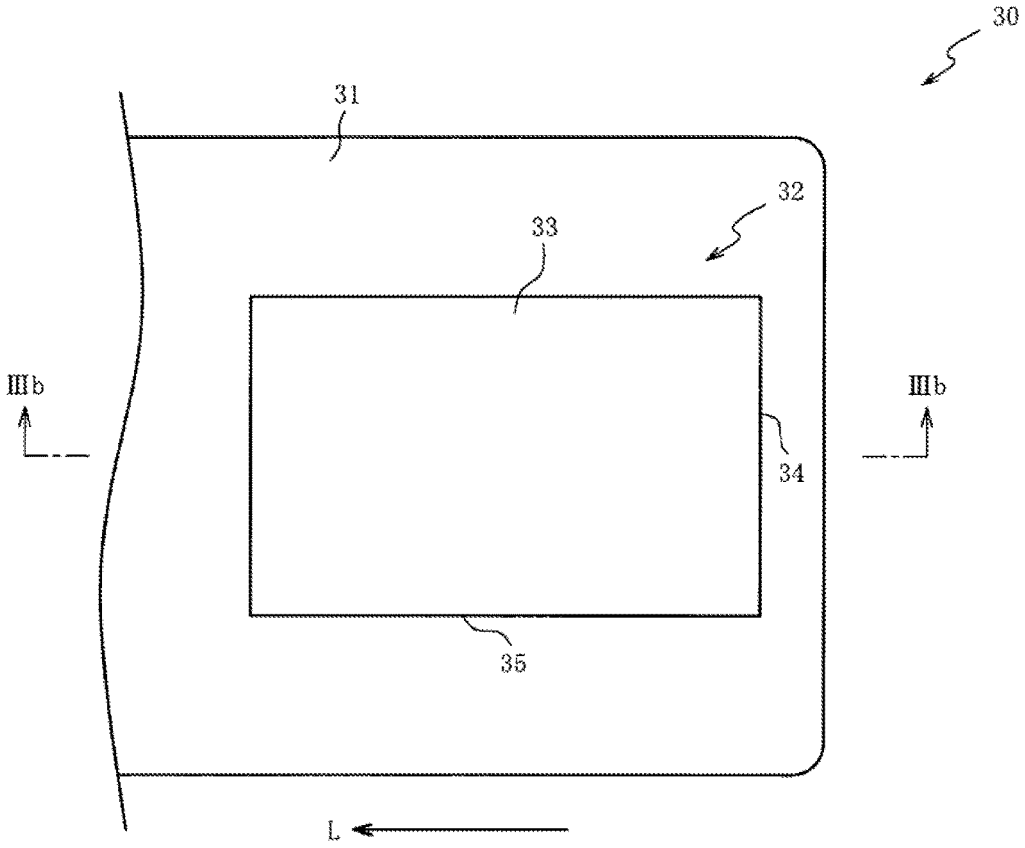
FIG. 3(*a*) is a plan view of a ground electrode.
Figure 3B:
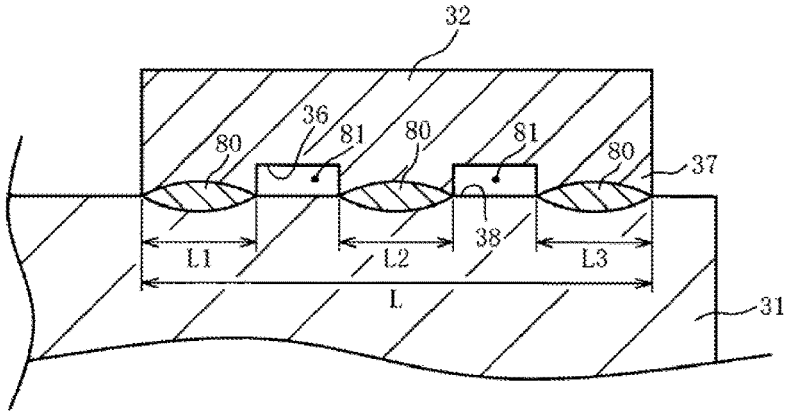
Figure 4A:
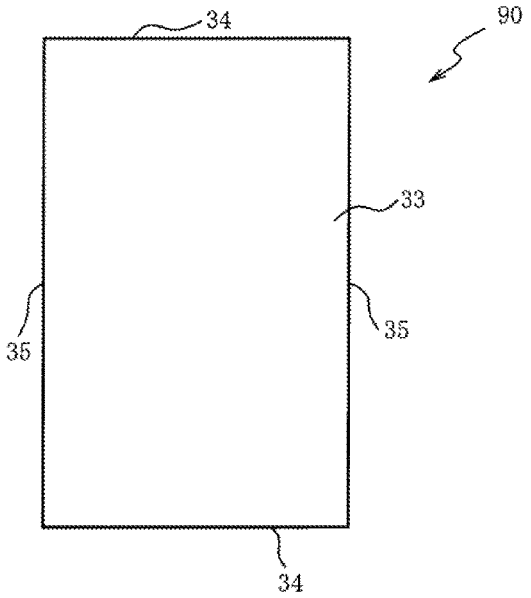
FIG. 4(*a*) is a plan view of a tip of a spark plug according to a second embodiment.
Figure 4B:
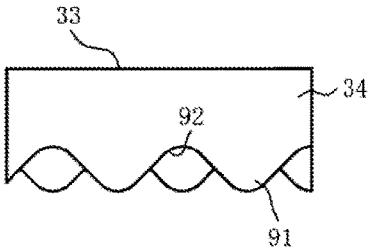
Figure 4D:
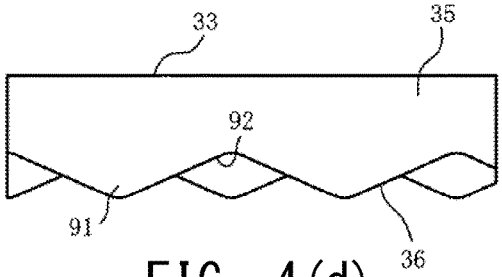
Figure 4C:
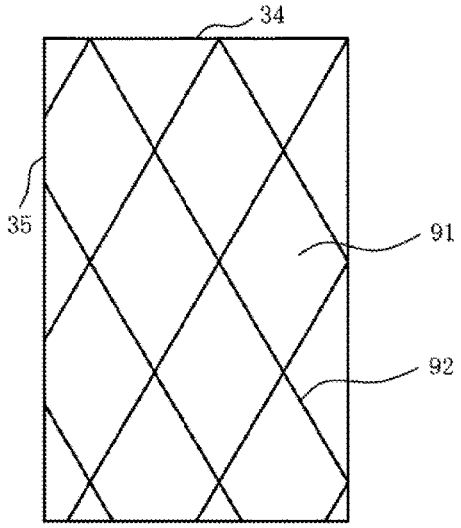

The ground electrode 30 will be described with reference to FIG. 3. FIG. 3(*a*) is a plan view of the ground electrode 30, and FIG. 3(*b*) is a cross-sectional view of the ground electrode 30 taken along the line represented by arrows IIIb-IIIb shown in FIG. 3(*a*). In FIG. 3(*a*), a portion of the electrode base material 31 in the longitudinal direction (the left-right direction in FIG. 1) is not shown. In FIG. 3(*b*), a portion of the electrode base material 31 in the thickness direction is not shown. An arrow L in FIG. 3(*a*) represents the longitudinal direction of the electrode base material 31.

As shown in FIG. 3(*a*), the tip 32 is disposed on a joining surface 38 (see FIG. 3(*b*)) of the electrode base material 31 such that the longitudinal direction of the tip 32 is along the longitudinal direction (the direction represented by the arrow L) of the electrode base material 31. As shown in FIG. 3(*b*), the joining surface 38 opposes the bottom surface 36 of the tip 32, and the tip 32 is joined to the joining surface 38. In other words, the joining surface 38 is a projection surface (surface representing the outer shape of the tip 32) obtained by the outer shape of the tip 32 being projected on the surface of the electrode base material 31. In the present embodiment, the tip 32 is joined to the electrode base material 31 by resistance welding.

FIG. 3(*b*) is a cross-sectional view of the tip 32 and the electrode base material 31 taken along the longitudinal direction (direction in which the line represented by arrows IIIb-IIIb extends) of the joining surface 38. The tip 32 is joined to the electrode base material 31 by welded portions 80. The welded portions 80 are formed by the tip 32 and the electrode base material 31 being melted, and are formed at positions at which the protrusions 37 contact with the electrode base material 31. The protrusions 37 protrude from the bottom surface 36 of the tip 32. Therefore, when pressure is appropriately applied to the tip 32 and the electrode base material 31 and electricity is applied thereto, the welded portions 80 are formed between the protrusions 37 and the electrode base material 31 due to Joule heat generated in contact resistance between the protrusions 37 and the electrode base material 31. Simultaneously when the welded portions 80 are formed, voids 81 are formed above the joining surface 38 between the protrusions 37, 37 adjacent to each other. The voids 81 are portions at which the electrode base material 31 and the bottom surface 36 of the tip 32 do not connect with each other.

The welded portion is divided into a plurality of welded portions 80 (three welded portions in the present embodiment) on the joining surface 38 by the voids 81 (two voids in the present embodiment) being formed above the joining surface 38. A continuous distance L1, a continuous distance L2, and a continuous distance L3 of the welded portions 80 on the joining surface 38 are each set to be less than or equal to 0.5 mm (excluding 0). As a result, as compared to a case where the entirety of the bottom surface 36 of the tip 32 is joined to the electrode base material 31, thermal stress caused by a difference in thermal expansion between the tip 32 and the electrode base material 31 can be reduced. In the present embodiment, L1=L2=L3 is satisfied. However, L1, L2, and L3 are not limited thereto. The distances L1, L2, and L3 can be set as appropriate in such a range that the distances L1, L2, and L3 are each less than or equal to 0.5 mm.

If the distances L1, L2, and L3 of the welded portions 80 are each greater than 0.5 mm, as each distance becomes greater, dimensional change, due to heat, of the electrode base material 31 and the tip 32 becomes too great to be ignored due to difference between a thermal expansion coefficient of the tip 32 and a thermal expansion coefficient of the electrode base material 31. Thus, ends of the welded portions 80 tend to be more likely to be peeled due to thermal stress. In the present embodiment, the distances L1, L2, and L3 are each set to be less than or equal to 0.5 mm, whereby peeling at the welded portions 80 due to thermal stress can be inhibited.

Further, the total L1+L2+L3 of the continuous distance L1, the continuous distance L2, and the continuous distance L3 of the welded portions 80 on the joining surface 38 is set to be 0.4 times to 0.8 times a length L (the length of the long side of the top surface 33), in the longitudinal direction, from the end of the tip 32 to the other end thereof. Thus, joining strength resistant to, for example, vibration of the internal combustion engine (not shown) to which the spark plug 10 is mounted, can be assured. As a result, peeling at the tip 32 or falling-off of the tip 32 can be inhibited against an external force such as thermal stress or vibration, thereby improving durability of the ground electrode 30.

If the total L1+L2+L3 of the distances L1, L2, and L3 is less than 0.4 times the length L of the tip 32, the less the total L1+L2+L3 is, the lower the joining strength of the welded portions 80 tends to be. Meanwhile, if the total L1+L2+L3 of the distances L1, L2, and L3 is greater than 0.8 times the length L of the tip 32, the greater the total L1+L2+L3 is, the more easily peeling at the welded portions 80 due to thermal stress tends to occur. In the present embodiment, the total L1+L2+L3 of the distances L1, L2, and L3 is set to be 0.4 times to 0.8 times the length L of the tip 32. Therefore, while peeling at the welded portions 80 due to thermal stress is inhibited, joining strength can be assured.

Next, a second embodiment will be described with reference to FIG. 4 and FIG. 5. In the first embodiment, the ground electrode 30 having the tip 32 in which the protrusions 37 are arranged almost parallel to each other, is described. Meanwhile, in the second embodiment, a tip 90 having twilled protrusions 91 is used. The same components as described for the first embodiment will be denoted by the same reference numerals, and the description thereof is not given.

FIG. 4(*a*) is a plan view of the tip 90 of a spark plug according to the second embodiment. FIG. 4(*b*) is a front view of the tip 90. FIG. 4(*c*) is a bottom view of the tip 90. FIG. 4(*d*) is a side view of the tip 90.

The tip 90 is a member that is formed, in a rectangular parallelepiped, of a noble metal or an alloy containing a noble metal as a main component. The tip 90 has a plurality of protrusions 91 on the rectangular bottom surface 36 disposed opposite to the top surface 33. In the present embodiment, the protrusions 91 are formed by twilled knurls which are obtained by grooves 92 being formed by rolling, cutting, or the like. The protrusions 91 can be easily formed by knurling.

A ground electrode 93 will be described with reference to FIG. 5. FIG. 5(*a*) is a plan view of the ground electrode 93. FIG. 5(*b*) is a cross-sectional view of the ground electrode 93 taken along the line represented by arrows Vb-Vb shown in FIG. 5(*a*) (the longitudinal direction of the joining surface 38). In FIG. 5(*a*) and FIG. 5(*b*), a portion of the electrode base material 31 in the longitudinal direction (the direction represented by the arrow L) is not shown. In FIG. 5(*b*), a portion of the electrode base material 31 in the thickness direction is not shown. Instead of the tip 32 of the spark plug 10 described for the first embodiment, the tip 90 is joined to the electrode base material 31.

Figure 5A:
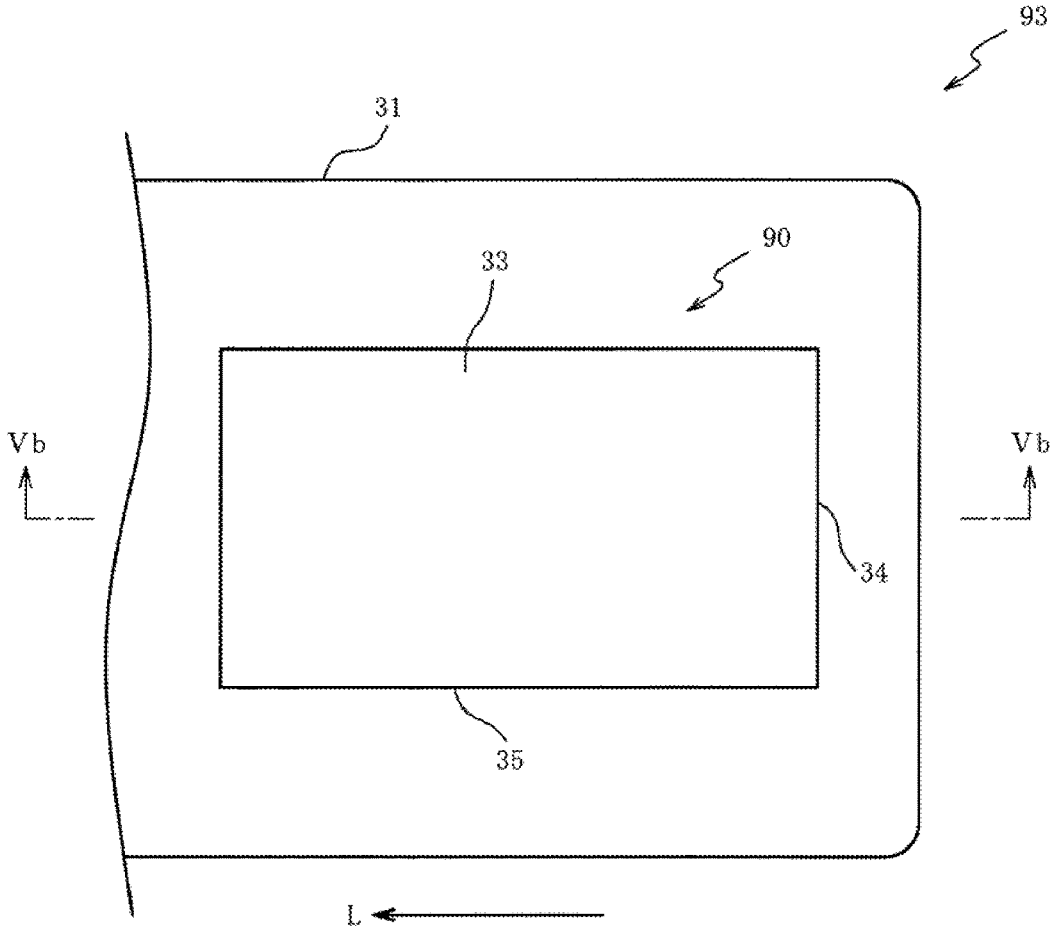
FIG. 5(*a*) is a plan view of a ground electrode.
Figure 5B:
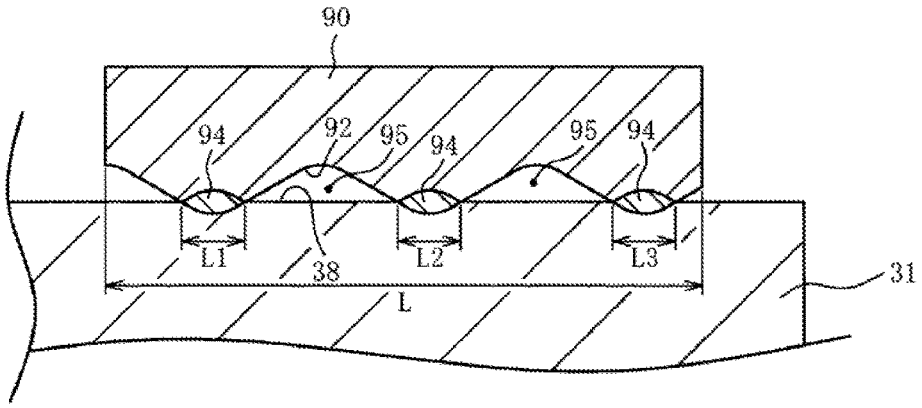

As shown in FIG. 5(*a*), the tip 90 is joined to the joining surface 38 (see FIG. 5(*b*)) of the electrode base material 31 by resistance welding such that the longitudinal direction of the tip 90 is along the longitudinal direction (the direction represented by the arrow L) of the electrode base material 31. As shown in FIG. 5(*b*), the tip 90 is joined to the electrode base material 31 by welded portions 94. The welded portions 94 are formed by the tip 90 and the electrode base material 31 being melted. The protrusions 91 protrude relative to the grooves 92. Therefore, in a case where the welded portions 94 are formed by resistance welding, voids 95 are formed by the grooves 92 above the joining surface 38 between the protrusions 91 adjacent to each other.

In a case where the voids 95 are formed above the joining surface 38, the welded portion is divided into n (n is an integer greater than or equal to 2) welded portions 94 on the joining surface 38. In the present embodiment, the welded portion is divided into three welded portions 94. A continuous distance L1 to a continuous distance Ln of the welded portions 94 on the joining surface 38 are each set to be less than or equal to 0.5 mm, and the total of the distances L1 to Ln is set to be 0.4 times to 0.8 times the length L from the end of the tip 90 to the other end thereof. Thus, the same action and effect as in the first embodiment can be obtained.

Further, the protrusions 91 (knurls) are uniformly arranged in the surface direction on the bottom surface 36 of the tip 90. Therefore, the welded portions 94 can be uniformly arranged on the joining surface 38. As a result, thermal stress generated in the welded portions 94 can be uniformly dispersed. Therefore, an effect of inhibiting, for example, peeling at the tip 90 can be enhanced.

Next, a third embodiment will be described with reference to FIG. 6. In the first embodiment and the second embodiment, the integral tips 32 and 90 are arranged on the electrode base materials 31 of the ground electrodes 30 and 93, respectively. Meanwhile, in the third embodiment, a tip 101 is formed by a plurality of divisional tips 102. The same components as described for the first embodiment will be denoted by the same reference numerals, and the description thereof is not given.

Figure 6A:
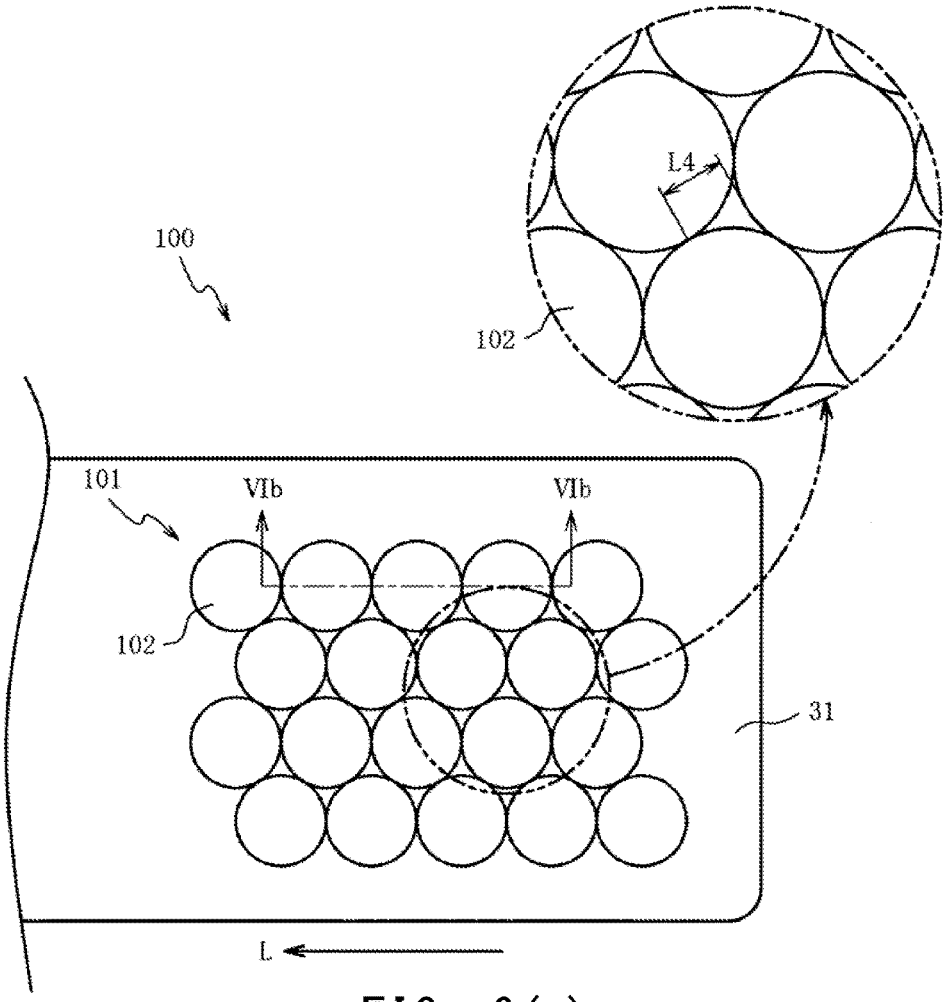
FIG. 6(*a*) is a plan view of a ground electrode of a spark plug according to a third embodiment.
Figure 6B:
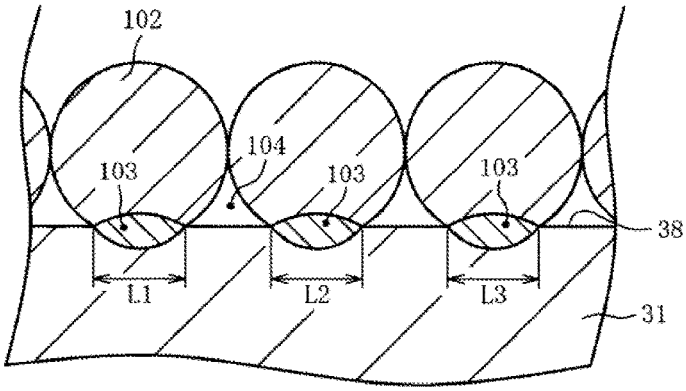

FIG. 6(*a*) is a plan view of a ground electrode 100 of a spark plug according to the third embodiment. FIG. 6(*b*) is a cross-sectional view of the ground electrode 100 taken along the line represented by arrows VIb-VIb shown in FIG. 6(*a*). In FIG. 6(*a*), a portion of the electrode base material 31 in the longitudinal direction (the direction represented by the arrow L) is not shown. In FIG. 6(*b*), portions of the electrode base material 31 in the longitudinal direction and the thickness direction are not shown.

As shown in FIG. 6(*a*), in the ground electrode 100, the tip 101 that includes the plurality of divisional tips 102 is disposed on the electrode base material 31. In the present embodiment, the divisional tips 102 are each a spherical body that is formed of a noble metal or an alloy containing a noble metal as a main component and that has a radius of about 0.1 mm to about 0.3 mm. The plurality of divisional tips 102 are substantially tightly arranged on the joining surface 38 (see FIG. 6(*b*)) of the electrode base material 31 such that the shape of the tip 101 is almost rectangular as a whole in the planar view, and the divisional tips 102 are not stacked and layered on each other. The divisional tips 102 are spherical bodies having no directivity. Therefore, in a case where a region of the tip 101 formed by the divisional tips 102 is regulated, the divisional tips 102 can be easily arranged on the electrode base material 31.

The joining surface 38 is a projection surface (surface representing the outer shape of the tip 101) obtained by the tip 101 formed by arrangement of the divisional tips 102 being projected on the surface of the electrode base material 31. In the present embodiment, the divisional tips 102 are joined to the electrode base material 31 by resistance welding. In a case where the divisional tips 102 oppose the joining surface 38, a maximum spatial distance L4 (maximum distance between the divisional tips 102 on the projection surface formed on the joining surface 38 in the case of the divisional tips 102 being projected on the joining surface 38) between the divisional tips 102 adjacent to each other, is set to be less than or equal to 0.3 mm.

FIG. 6(*b*) is a cross-sectional view of the tip 101 and the electrode base material 31 taken along the longitudinal direction (direction in which the line represented by arrows VIb-VIb extends) of the joining surface 38. The divisional tips 102 are joined to the electrode base material 31 (joining surface 38) by welded portions 103. The welded portions 103 are formed by the divisional tips 102 and the electrode base material 31 being melted, and the welded portion 103 is formed for each divisional tip 102. Voids 104 are formed between the divisional tips 102 adjacent to each other so as to divide a welded portion into the welded portions 103 on the joining surface 38. The voids 104 are regions, formed by the divisional tips 102 contacting with each other, where the welded portions 103 cannot be formed.

The welded portion is divided into n (n is an integer greater than or equal to 2) welded portions 103 on the joining surface 38 by the voids 104 being formed above the joining surface 38. A continuous distance L1 to a continuous distance Ln (indicated as L1, L2, L3 in FIG. 6(*b*)) of the welded portions 103 on the joining surface 38 are each set to be less than or equal to 0.5 mm, and the total of the distances L1 to Ln is set to be 0.4 times to 0.8 times the length L from the end of the tip 101 to the other end thereof. Thus, the same action and effect as in the first embodiment can be obtained.

The maximum spatial distance L4 between the divisional tips 102 is set to be less than or equal to 0.3 mm. Therefore, spark discharge can be less likely to occur between the center electrode 50 and regions of the electrode base material 31 which are located between the divisional tips 102. As a result, while spark wear of the electrode base material 31 is reduced, peeling at the tip or falling-off of the tip due to thermal stress, vibration, or the like can be less likely to occur, whereby durability of the ground electrode can be improved.

Next, a fourth embodiment will be described with reference to FIG. 7. In the first embodiment to the third embodiment, the tips 32, 90, and 101 are joined to the electrode base materials 31 by resistance welding. Meanwhile, in the fourth embodiment, a tip 111 (divisional tips 112) is joined to the electrode base material 31 by laser beam welding. The same components as described for the first embodiment will be denoted by the same reference numerals, and the description thereof is not given.

Figure 7A:
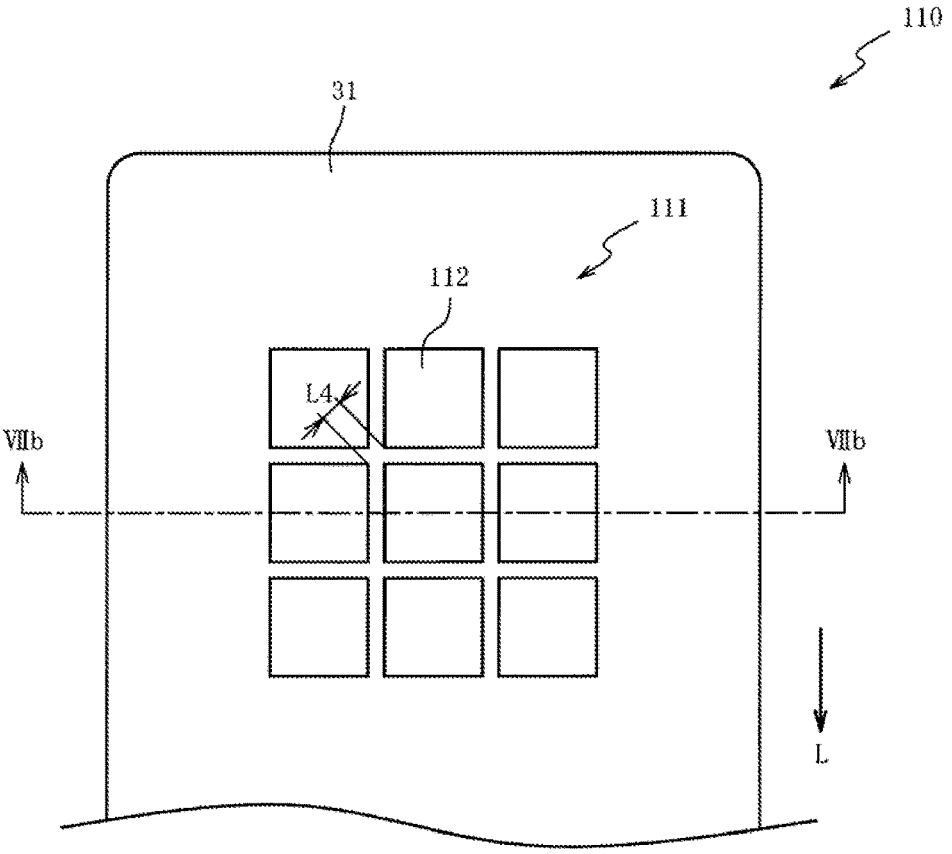
FIG. 7(*a*) is a plan view of a ground electrode of a spark plug according to a fourth embodiment.
Figure 7B:
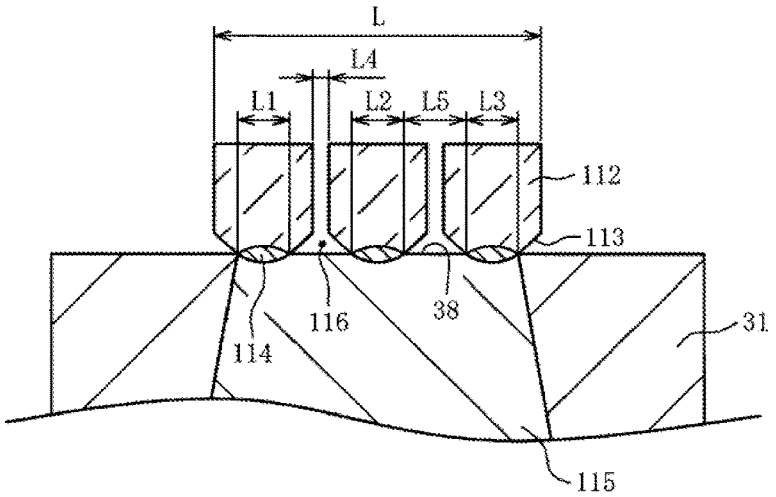

FIG. 7(*a*) is a plan view of a ground electrode 110 of a spark plug according to the fourth embodiment. FIG. 7(*b*) is a cross-sectional view of the ground electrode 110 taken along the line represented by arrows VIIb-VIIb shown in FIG. 7(*a*). In FIG. 7(*a*), a portion of the electrode base material 31 in the longitudinal direction (the direction represented by the arrow L) is not shown. In FIG. 7(*b*), a portion of the electrode base material 31 in the thickness direction is not shown. Instead of the ground electrode 30 of the spark plug 10 described for the first embodiment, the ground electrode 110 is joined to the metal shell 20.

As shown in FIG. 7(*a*), in the ground electrode 110, the tip 111 that includes a plurality of divisional tips 112 is disposed on the electrode base material 31. In the present embodiment, the divisional tips 112 are each a member which is formed, into almost a quadrangular prism, of a noble metal or an alloy containing a noble metal as a main component. The plurality of divisional tips 112 are arranged on the joining surface 38 (see FIG. 7(*b*)) of the electrode base material 31 such that the shape of the tip 111 is almost square as a whole in the planar view.

The joining surface 38 is a projection surface (surface representing the outer shape of the tip 111) obtained by the tip 111 formed by arrangement of the divisional tips 112 being projected on the surface of the electrode base material 31. In the present embodiment, the divisional tips 112 are joined to the electrode base material 31 by laser beam welding. In a case where the divisional tips 112 oppose the joining surface 38, a maximum spatial distance L4 (maximum distance between the divisional tips 112 on the projection surface formed on the joining surface 38 in the case of the divisional tips 112 being projected on the joining surface 38) between the divisional tips 112 adjacent to each other, is set to be less than or equal to 0.3 mm. Thus, as in the third embodiment, spark wear can be reduced in the electrode base material 31 (region of L4).

FIG. 7(*b*) is a cross-sectional view of the tip 111 and the electrode base material 31 taken along the longitudinal direction (direction in which the line represented by arrows VIIb-VIIb extends) of the joining surface 38. The joining surface 38 has an almost square shape. Therefore, the longitudinal direction of the joining surface 38 may be set to be the same as the longitudinal direction (the direction represented by the arrow L in FIG. 7(*a*)) of the electrode base material 31, or may be set to be the same as the transverse direction (the direction orthogonal to the direction represented by the arrow L) of the electrode base material 31. In the present embodiment, the longitudinal direction of the joining surface 38 is set so as to be the same as the transverse direction of the electrode base material 31.

In each divisional tip 112, a tilt surface 113 by which an area of the bottom surface (surface that contacts with the joining surface 38) is reduced as compared to a cross-sectional area of the divisional tip 112, is formed between the bottom surface and the side surfaces. The divisional tips 112 are joined to the electrode base material 31 by welded portions 114. The welded portions 114 are formed by the electrode base material 31 and the divisional tips 112 being melted, and the welded portion 114 is formed for each divisional tip 112. The welded portions 114 connect with a melt portion 115 formed by the electrode base material 31 being melted. The melt portion 115 is a portion, of the electrode base material 31, which is melted by laser light applied from the rear surface side of the electrode base material 31, and is formed on the rear surface side of the joining surface 38 of the electrode base material 31. The tilt surfaces 113 of the divisional tips 112 are not joined to the electrode base material 31. Therefore, the welded portions 114 are formed such that voids 116 are each formed between the divisional tips 112 adjacent to each other so as to connect with the joining surface 38.

In FIG. 7(*b*), for easy understanding, the welded portions 114 and the melt portion 115 are indicated so as to be distinguished from each other (hatching is different). However, in practice, the welded portions 114 and the melt portion 115 are continuous with each other. In the welded portions 114, the concentration of the noble metal into which the divisional tips 112 are melted is higher than in the melt portion 115. However, a boundary between the welded portions 114 and the melt portion 115 is not clearly defined.

The welded portion is divided into the three welded portions 114 on the joining surface 38 by the voids 116 being formed above the joining surface 38. A continuous distance L1 to a continuous distance L3 of the welded portions 114 on the joining surface 38 are each set to be less than or equal to 0.5 mm, and the total of the distances L1 to L3 is set to be 0.4 times to 0.8 times the length L from the end of the tip 111 to the other end thereof. Thus, the same function effect as in the third embodiment can be obtained.

EXAMPLES

The present invention will be more specifically described according to examples. However, the present invention is not limited to the examples.

Experimental Examples 1 to 20

Samples according to experimental examples 1 to 20 were produced in a manner similar to that for the spark plug 10 described in the first embodiment. The samples were each a spark plug which had a screw portion of which the nominal diameter was M12. In the center electrode, a tip formed of iridium in a columnar shape having the diameter of 0.6 mm was joined to the end of the leg portion by resistance welding.

The tip of the ground electrode was formed of platinum in a rectangular parallelepiped. The tip had the width of 1 mm, the length of 1.5 mm, and the thickness of 0.4 mm. 19 kinds of tips were prepared such that grooves were formed at one to three portions on the bottom surface of the tip so as to extend in the tip width direction, and protrusions having the same length were formed parallel with each other so as to be separated by various grooves in the tips.

Each protrusion of the tip was pressed onto the electrode base material formed of INCONEL (registered trademark) 600, and the tip was joined to the electrode base material by resistance welding, thereby obtaining samples, of experimental examples 1 to 19, having various ground electrodes. In each sample, a 0.2 mm gap was formed between the joining surface of the electrode base material and the groove bottom of the tip. In addition to these tips, a tip having no grooves and no protrusions was prepared, and the bottom surface (the width of 1 mm, the length of 1.5 mm) of the tip was pressed onto the electrode base material to perform resistance welding, thereby obtaining a sample of experimental example 20.

The samples of experimental examples 1 to 20 were each mounted to a turbocharged engine (displacement of 1.5L). A test in which the engine revolution was set as the engine revolution for idling for 90 seconds and the engine revolution of 6000 rpm (full throttle) for 90 seconds, was regarded as one cycle of test, and the test was repeatedly performed for 1000 cycles.

After the tests, each sample was removed from the engine, and the longitudinal cross-sections of the tip and the electrode base material were observed, and the proportion (length of oxide scale/continuous distance of the welded portion on the joining surface) of the length of a peeled tip portion was measured and evaluated. As the length of the oxide scale, the length of the longest oxide scale among oxide scales in the observed cross-section was adopted. The evaluation is "excellent" when the proportion of the length of the peeled tip portion was less than 30%, is "good" when the proportion thereof was greater than or equal to 30% and less than 50%, is "slightly poor" when the proportion thereof was greater than or equal to 50% and less than 70%, and is "poor" when the proportion thereof was greater than or equal to 70%.

Table 1 indicates a list of: the continuous distance (mm) of the welded portion on the joining surface; the number (pieces) of the welded portions; the total length (mm) of voids above the joining surface; the number (pieces) of the voids; a ratio of the total of distances of the welded portions to the length of the tip (represented as "proportion of welded portion"); the length of oxide scale/continuous distance of the welded portion on the joining surface (represented as "proportion of scale (%)"); and evaluation. The continuous distance (each of L1 to Ln) of the welded portion on the joining surface is determined according to the length of the protrusion, and the number and the total length of the voids are determined according to the number and the total length of grooves.

TABLE 1

| | Welded portion | | Void | | | | |
|---|---|---|---|---|---|---|---|
| | Distance (mm) | The number (pieces) | Total length (mm) | The number (pieces) | Proportion of welded portion | Proportion of scale (%) | Evaluation |
| Experimental example 1 | 0.2 | 2 | 1.1 | 1 | 0.27 | 60 | Slightly poor |
| Experimental example 2 | 0.3 | 2 | 0.9 | 1 | 0.40 | 45 | Good |
| Experimental example 3 | 0.4 | 2 | 0.7 | 1 | 0.53 | 40 | Good |
| Experimental example 4 | 0.5 | 2 | 0.5 | 1 | 0.67 | 38 | Good |
| Experimental example 5 | 0.6 | 2 | 0.3 | 1 | 0.80 | 65 | Slightly poor |
| Experimental example 6 | 0.7 | 2 | 0.1 | 1 | 0.93 | 68 | Slightly poor |
| Experimental example 7 | 0.1 | 3 | 1.2 | 1 | 0.20 | 65 | Slightly poor |
| Experimental example 8 | 0.15 | 3 | 1.05 | 2 | 0.30 | 62 | Slightly poor |
| Experimental example 9 | 0.2 | 3 | 0.9 | 2 | 0.40 | 38 | Good |
| Experimental example 10 | 0.3 | 3 | 0.6 | 2 | 0.60 | 35 | Good |
| Experimental example 11 | 0.4 | 3 | 0.3 | 2 | 0.80 | 38 | Good |
| Experimental example 12 | 0.45 | 3 | 0.15 | 2 | 0.90 | 40 | Good |
| Experimental example 13 | 0.05 | 4 | 1.3 | 3 | 0.13 | 60 | Slightly poor |
| Experimental example 14 | 0.1 | 4 | 1.1 | 3 | 0.27 | 65 | Slightly poor |
| Experimental example 15 | 0.15 | 4 | 0.9 | 3 | 0.40 | 35 | Good |
| Experimental example 16 | 0.2 | 4 | 0.7 | 3 | 0.53 | 32 | Good |
| Experimental example 17 | 0.25 | 4 | 0.5 | 3 | 0.67 | 33 | Good |
| Experimental example 18 | 0.3 | 4 | 0.3 | 3 | 0.80 | 40 | Good |
| Experimental example 19 | 0.35 | 4 | 0.1 | 3 | 0.93 | 42 | Good |
| Experimental example 20 | 1.5 | 1 | 0 | 0 | 1 | 70 | Poor |

According to Table 1, it has been confirmed that, in experimental examples 1 to 19 in which the voids were formed at the welded portions, peeling at the tip was less likely to occur as compared to experimental example 20 in which the entirety of the bottom surface of the tip was welded (no voids were formed at the welded portions). In particular, it has been confirmed that, in any of experimental examples 2 to 4, 9 to 11, and 15 to 18 in which the distance of the welded portion was less than or equal to 0.5 mm and the total of the distances of the welded portions was 0.4 times to 0.8 times the length of the tip, the evaluation is "good". In these experimental examples, the peeling at the tip was able to be inhibited, and it is thus clear that durability of the ground electrode can be improved.

Experimental Examples 21 to 26

The tip according to the tip of experimental example 16 was cut at positions of the grooves in the width direction, and divided into four divisional tips having the same size such that each divisional tip had the width of 1 mm, the length of 0.35 mm, and the thickness of 0.4 mm. Each divisional tip had a protrusion having the width of 1 mm and the length of 0.2 mm.

The four divisional tips were arranged on the electrode base material formed of INCONEL (registered trademark) 600 such that the protrusions were parallel to each other, and the protrusions were pressed onto the electrode base material, and the divisional tips were joined to the electrode base material by resistance welding. When the divisional tips were arranged on the electrode base material, the maximum spatial distance (gap) between the divisional tips adjacent to each other was made different, to obtain samples according to experimental examples 21 to 26. In each sample, a 0.2 mm gap was formed between the joining surface of the electrode base material and the bottom surface of the divisional tip.

To the engine used in the test for experimental examples 1 to 20, the samples of experimental examples 21 to 26 were mounted, and the same test was performed for 1000 cycles. After the tests, each sample was removed from the engine, and the electrode base material (joining surface) at the gap between the divisional tips was observed, and the electrode base material was checked for a discharge mark caused by spark discharge. Subsequently, the cross-sections of the four divisional tips and the electrode base material were observed, and the proportion (length of oxide scale/continuous distance of the welded portion on the joining surface) of the length of the peeled divisional-tip portion was measured.

As the length of the oxide scale, the length of the longest oxide scale among oxide scales in the observed cross-section was adopted. The evaluation is "poor" when the discharge mark was found even if the oxide scale satisfied the standard. Table 2 indicates a list of: the continuous distance (mm) of the welded portion on the joining surface; the number (pieces) of the welded portions; the maximum spatial distance between the divisional tips (represented as "spatial distance (mm)"); the length of oxide scale/continuous distance of the welded portion on the joining surface (represented as "proportion of scale (%)"); presence or absence of a discharge mark at the electrode base material; and evaluation. For comparison, the result of experimental example 16 is also indicated in Table 2.

TABLE 2

| | Welded portion | | The number | Spatial | Proportion | Presence or absence of | |
|---|---|---|---|---|---|---|---|
| | Distance (mm) | The number (pieces) | of voids (pieces) | distance (mm) | of scale (%) | discharge mark | Evaluation |
| Experimental example 21 | 0.2 | 4 | 3 | <0.1 | 32 | absent | Good |
| Experimental example 22 | 0.2 | 4 | 3 | 0.1 | 25 | absent | Excellent |
| Experimental example 23 | 0.2 | 4 | 3 | 0.2 | 25 | absent | Excellent |
| Experimental example 24 | 0.2 | 4 | 3 | 0.3 | 24 | absent | Excellent |
| Experimental example 25 | 0.2 | 4 | 3 | 0.4 | 21 | present | Poor |
| Experimental example 26 | 0.2 | 4 | 3 | 0.5 | 20 | present | Poor |
| Experimental example 16 | 0.2 | 4 | 3 | — | 32 | — | Good |

According to Table 2, in experimental examples 22 to 24 in which the maximum spatial distance between the divisional tips was 0.1 mm to 0.3 mm, no discharge mark was found in the electrode base material. Further, it has been confirmed that, in experimental examples 22 to 24, peeling at the tip was less likely to occur as compared to experimental example 16. It is assumed that, by the tip being divided, thermal stress can be further reduced. It is assumed that, in experimental examples 22 to 24, peeling at the tip can be reduced, and spark wear of the electrode base material can be also reduced. Therefore, it is clear that durability of the ground electrode can be improved.

According to these examples, it has been confirmed that, even if the tip (including the tip in which the total of the lengths of a plurality of arranged divisional tips is greater than or equal to 1.5 mm) has the length which is greater than or equal to 1.5 mm, when a plurality of welded portions each having a continuous distance which is less than or equal to 0.5 mm are provided, peeling at the tip can be less likely to occur.

As described above, although the present invention has been described based on the embodiments, the present invention is not limited to the above embodiments at all. It can be easily understood that various modifications can be devised without departing from the gist of the present invention.

For easy understanding, in the above embodiments, the voids 81, 95, 104, 116 at the joining surface 38 are formed without bringing the tips 32, 90, 101, 111 and the electrode base material 31 into contact with each other. However, the present invention is not necessarily limited thereto. The voids function to reduce thermal stress unless the tip and the electrode base material are joined to each other. As a matter of course, the voids may be formed also by the tip and the electrode base material contacting with each other (for example, a distance between: the joining surface 38; and the bottom surface 36 or the groove 92 is almost zero).

In the first embodiment and the second embodiment, the tips 32, 90 have the protrusions 37, 91 to form the voids 81, 95 at the joining surface 38. However, the present invention is not necessarily limited thereto. As a matter of course, in a case where the tip is joined to the electrode base material 31 by laser beam welding, for example, the joining surface 38 is scanned with laser light from the rear surface side of the electrode base material 31 while energy density is varied, whereby the welded portions and the voids can be formed on the bottom surface of the tip without forming the protrusions 37, 91.

In the second embodiment, the tip 90 having twilled knurls is described. However, the present invention is not necessarily limited thereto. As a matter of course, straight knurls or diagonal knurls may be formed on the tip. Further, protrusions may not be regularly formed by knurling. As a matter of course, protrusions may be irregularly formed by cutting.

In the third embodiment and the fourth embodiment, the divisional tips 102 having the same size and the divisional tips 112 having the same size are used. However, the present invention is not limited thereto. The sizes of the divisional tips can be determined as appropriate.

In each of the above embodiments, the tips 32, 90, 101, 111 are arranged so as to form almost a rectangular shape or almost a square shape in the planar view (when opposing the joining surface 38). However, the present invention is not necessarily limited thereto. The shape of the tip can be set, as appropriate, so as to be circular, ellipsoidal, oblong, or the like in the planar view. In a case where the shape of the tip is, for example, ellipsoidal or oblong in the planar view, the cross-section, in the longitudinal direction, of the joining surface 38 means the cross-section, in the major axis direction, of the ellipsoidal or oblong shape. In a case where the shape of the tip is circular in the planar view, the cross-section, in the longitudinal direction, of the joining surface 38 means the cross-section that passes through the center of the circle.

In each of the above embodiments, the embodiment may be modified by a part or plural parts of the structure of another embodiment being added to the embodiment or a part or plural parts of the structure being exchanged between the embodiment and another embodiment.

For example, in the first embodiment to the third embodiment, the welded portions 80, 94, 103 are formed by resistance welding. However, as a matter of course, as in the fourth embodiment, the welded portions may be formed by laser beam welding being performed from the rear surface side of the electrode base material 31 toward the tips 32, 90, or the divisional tips 112. Further, the welded portions may be formed by laser beam welding being performed from the tips 32, 90 side or the divisional tips 112 side toward the electrode base material 31. Similarly, as a matter of course, the divisional tips 112 of the fourth embodiment may be joined to the electrode base material 31 by resistance welding.

DESCRIPTION OF REFERENCE NUMERALS

10: spark plug
30, 93, 100, 110: ground electrode
31: electrode base material
32, 90, 101, 111: tips
38: joining surface
50: center electrode
80, 94, 103, 114: welded portions
81, 95, 104, 116: voids
102, 112: divisional tips

What is claimed is:

1. A spark plug comprising:
a center electrode; and
a ground electrode including: an electrode base, and a tip comprised of a noble metal joined to a joining surface of the electrode base via a plurality of welded portions, wherein the tip is positioned opposite the center electrode and separated from the center electrode by a spark gap; wherein
on cross-sections of the tip and the electrode base in a longitudinal direction of the joining surface,
the tip defines one or more voids above the joining surface and between the plurality of welded portions,
a continuous distance of each of the welded portions on the joining surface in the longitudinal direction is less than or equal to 0.5 mm, and
a total of the continuous distances of the welded portions is 0.4 times to 0.8 times a length from an end of the tip to an other end thereof.

2. The spark plug according to claim 1, wherein
the tip is comprised of a plurality of divisional tips arranged on the joining surface, wherein the welded portions join each of the divisional tips to the joining surface, and
wherein a maximum spatial distance, on the joining surface, between the divisional tips adjacent to each other is less than or equal to 0.3 mm.

3. The spark plug according to claim 1, wherein
on the cross-sections of the tip and the electrode base in the longitudinal direction of the joining surface,
the length from the end of the tip to the other end thereof is greater than or equal to 1.5 mm.

* * * * *